US007896108B2

(12) United States Patent
Able et al.

(10) Patent No.: US 7,896,108 B2
(45) Date of Patent: Mar. 1, 2011

(54) DUAL STRING ORBITAL DRILLING SYSTEM

(76) Inventors: Robert E. Able, Bozeman, MT (US); Charles C. Able, Waltham, MA (US)

( * ) Notice: Subject to any disclaimer, the term of this patent is extended or adjusted under 35 U.S.C. 154(b) by 92 days.

(21) Appl. No.: 12/381,019

(22) Filed: Mar. 6, 2009

(65) Prior Publication Data

US 2009/0223719 A1 Sep. 10, 2009

Related U.S. Application Data

(60) Provisional application No. 61/068,383, filed on Mar. 6, 2008.

(51) Int. Cl.
*E21B 7/04* (2006.01)
*E21B 7/08* (2006.01)

(52) U.S. Cl. ..... 175/173; 175/80; 175/113

(58) Field of Classification Search ..... 175/80, 175/113, 173
See application file for complete search history.

(56) References Cited

U.S. PATENT DOCUMENTS

| | | | | |
|---|---|---|---|---|
| 3,565,190 | A * | 2/1971 | Ishii | 175/171 |
| 3,963,076 | A | 6/1976 | Winslow | |
| 3,970,335 | A * | 7/1976 | Curington et al. | 285/123.3 |
| 4,618,172 | A | 10/1986 | Becker | |
| 4,691,790 | A | 9/1987 | Reichman et al. | |
| 4,844,182 | A | 7/1989 | Tolle | |
| 4,913,466 | A | 4/1990 | Becker | |
| 4,940,098 | A | 7/1990 | Moss | |
| 5,186,266 | A | 2/1993 | Heller | |
| 5,862,866 | A | 1/1999 | Springer | |
| 6,015,015 | A | 1/2000 | Luft et al. | |
| 6,065,550 | A | 5/2000 | Gardes | |
| 6,588,509 | B2 | 7/2003 | Allyn et al. | |
| RE38,418 | E * | 2/2004 | Deken et al. | 175/19 |
| 6,761,231 | B1 * | 7/2004 | Dock et al. | 175/51 |
| 6,827,158 | B1 * | 12/2004 | Dimitroff et al. | 175/62 |
| 7,077,165 | B2 | 7/2006 | Takasaki et al. | |
| 7,152,700 | B2 | 12/2006 | Church et al. | |
| 7,311,148 | B2 | 12/2007 | Giroux et al. | |
| 2003/0132034 | A1 * | 7/2003 | Sharp et al. | 175/62 |
| 2003/0141111 | A1 * | 7/2003 | Pia | 175/57 |
| 2005/0167158 | A1 * | 8/2005 | Fanuel et al. | 175/61 |
| 2007/0017707 | A1 * | 1/2007 | Fanuel et al. | 175/73 |

FOREIGN PATENT DOCUMENTS

WO WO 2006/014417 A2 2/2006

* cited by examiner

*Primary Examiner* — David J Bagnell
*Assistant Examiner* — Michael Wills, III
(74) *Attorney, Agent, or Firm* — Richard C. Conover

(57) ABSTRACT

A dual string drilling system for drilling a well bore in an earth formation, having a rotatable, tubular outer drill string and an upper rotatable, tubular inner drill string. An elongate tubular drill bit is mounted to a distal end of the outer drill string. The tubular drill bit having an interior passageway having a longitudinal axis which is inclined with respect to the longitudinal axis of the outer drill string. The drill bit is further provided with a cutaway portion extending through a wall of the tubular outer drill string. A lower rotatable inner drill string is coupled to the upper rotatable tubular inner drill string and is disposed within the interior passageway of the drill bit. A second drill bit is mounted to the distal of the lower inner drill string and is sized to extend beyond the drill bit mounted to the outer drill string.

6 Claims, 8 Drawing Sheets

DUAL STRING ORBITAL DRILLING SYSTEM

This application claims the benefit of provisional application Ser. No. 61/068,383 filed Mar. 6, 2008.

BACKGROUND OF INVENTION

The present invention relates to a dual string orbital drilling system for drilling bore holes in earth formations. The present invention has significant advantages when drilling through fractured rock.

Generally bore holes are formed by rotating a drill string which may be several hundred feet in length into an earth formation. Dual wall drilling systems are known. For example, U.S. Pat. No. 4,618,172 to Becker shows a dual wall drill pipe having an outer pipe with a drill bit mounted at the drilling end of the outer pipe and an inner pipe used for providing a passageway for returning drilling fluid directed to the drill bit returning the drilling fluid to the surface. U.S. Pat. No. 4,940,098 to Moss shows another dual wall drilling system where the inner pipe is used for returning drilling fluid to the surface and a drill bit is mounted at the drilling end of the outer pipe.

A need exists, however, for a dual string drilling system where both the outer drilling string and an inner drilling string are used together to drill a bore hole.

A need also exists for a drilling system which allows an inner drilling string to perform drilling operations while being supported by an outer drill string which then allows the outer drill string and the inner drill string to be of reduced diameter thereby enabling a user to use the drilling system for drilling small holes approximately 3" in diameter for long depths such as 10,000 feet.

SUMMARY OF INVENTION

The present invention relates to a dual string drilling system for drilling a well bore in an earth formation, having a rotatable, tubular outer drill string and an upper rotatable, tubular inner drill string concentrically disposed in spaced apart relation with the outer drill string. An elongate tubular driver shoe is mounted to a distal end of the outer drill string. The driver shoe mounted to the outer drill string having an interior passageway having a longitudinal axis which is inclined with respect to the longitudinal axis of the outer drill string. The driver shoe mounted to the outer drill string further provided with a cutaway portion extending through a wall of the tubular outer drill string. A lower rotatable inner drill string is coupled to the upper rotatable tubular inner drill string for rotation therewith and is disposed within the interior passageway of the driver shoe mounted to the outer drill string. A drill bit is mounted to the distal end of the lower inner drill string and is sized to extend beyond the drive shoe mounted to the outer drill string. A passageway is provided for injecting drilling fluid through the tubular inner drill string to the drill bits in the well bore and then returning the drilling fluid through a passageway between the inner drill string performs the drilling operations.

BRIEF DESCRIPTION OF THE DRAWINGS

In order that the invention may be clearly understood and readily carried into effect, a preferred embodiment of the invention will now be described, by way of example only, with reference to the accompanying drawings wherein.

DESCRIPTION OF A PREFERRED EMBODIMENT

Figure 1:
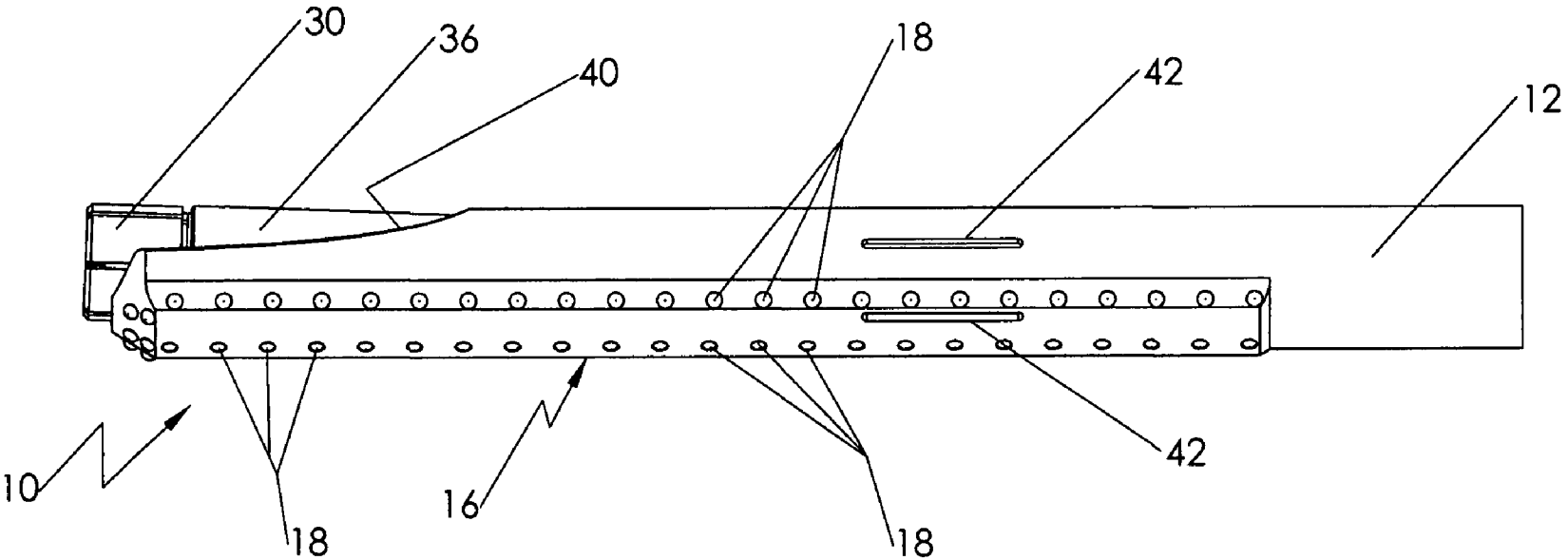
FIG. 1 is an elevational view of a dual string orbital drilling system according to the present invention.
Figure 2:
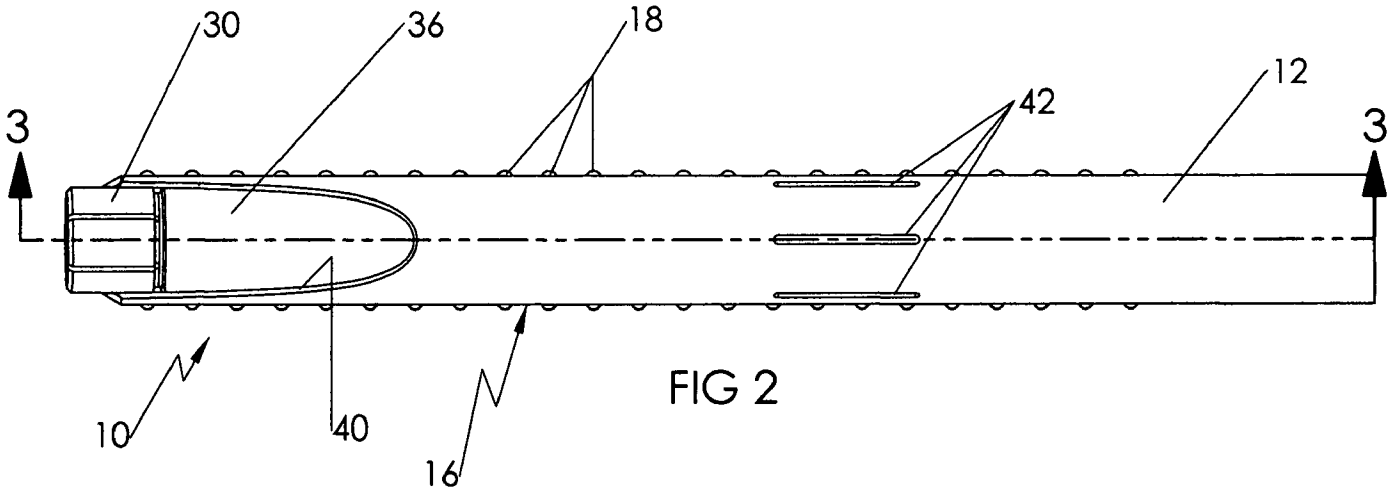
FIG. 2 is a top view of the drilling system shown in FIG. 1.
Figure 3:
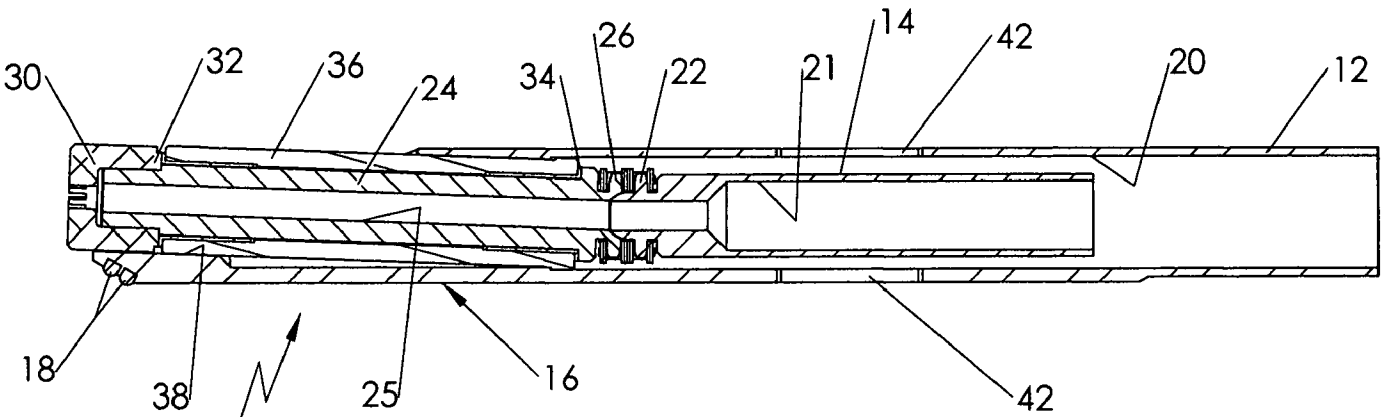
FIG. 3 is a cross-sectional view taken along the line 3-3 in FIG. 2.
Figure 16:
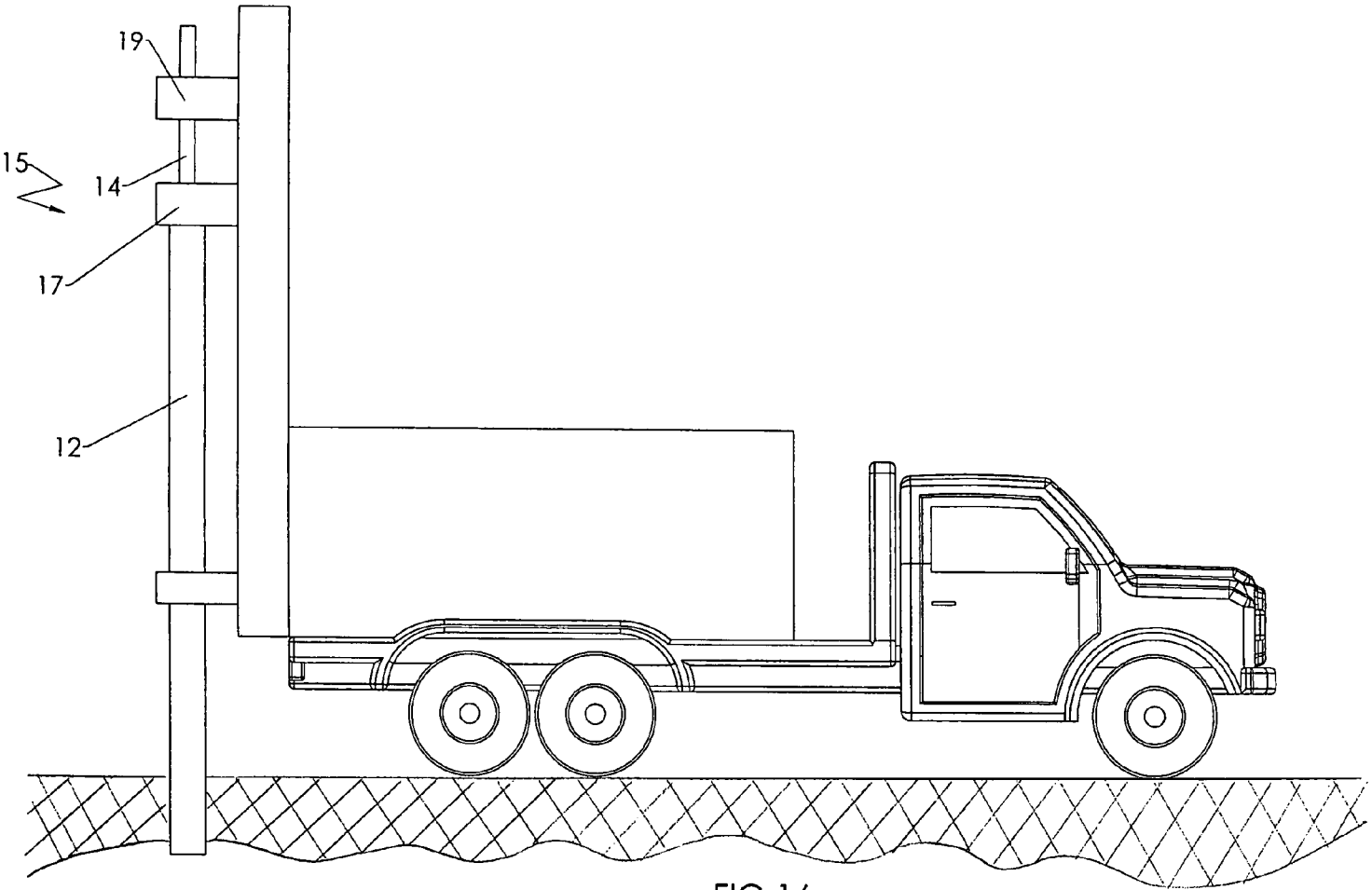
FIG. 16 is a diagrammatic representation of a conventional drilling rig having an inner drill string and an outer drill string connected thereto.

A dual string orbital drilling system 10 is shown in FIGS. 1-3. The drilling system 10 includes a tubular outer string 12 and an upper tubular inner string 14. Each of the drill strings 12 and 14 are connected to a conventional drilling rig 15, as shown in FIG. 16, located above the surface of the earth. The drilling rig 15 includes a drill head 17 connected to the outer string 12 and a second drill head 19 connected to the inner drill string 14 for rotating the drill strings independently of one another.

The outer string 12 is provided with an elongate outer string drill bit driver shoe 16 in which carbide bearing buttons 18 are mounted for bearing against the exposed bore hole surface when drilling a bore hole.

The upper inner drill string 14 is concentrically positioned inside the outer drill string 12. The inner drill string 14 has an interior passageway 21 and the inner drill string 14 has an outside diameter smaller than the inside diameter of the outer drill string 12, leaving a passageway 20 between the inner string 14 and the outer string 12. At the lower end of upper inner string 14, a chain sprocket 22 is formed on the outside wall of inner string 14 as shown in FIGS. 3 and 5-7.

Figure 13:
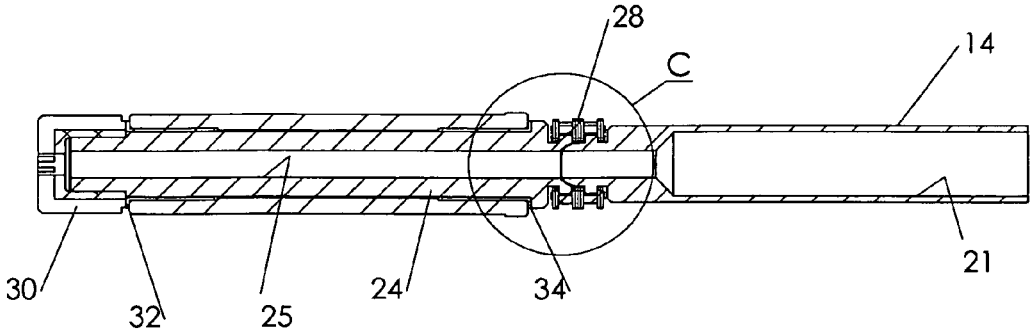
FIG. 13 is a cross-sectional view taken along the line 13-13 in FIG. 12.
Figure 14:
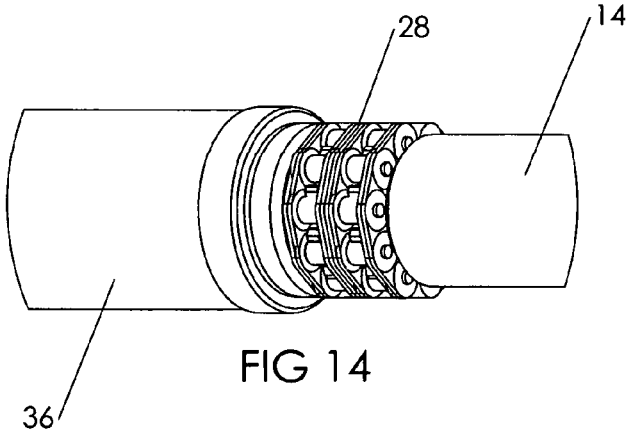
FIG. 14 is a detail view taken at A in FIG. 11.

A lower inner drill string assembly 24 is positioned below the upper inner drill string 14 as shown in FIG. 3. The lower inner drill string assembly 24 is provided with a chain sprocket 26 as shown in FIGS. 3 and 8-10. A conventional roller chain flexible coupling 28 is wrapped around sprockets 22 and 26 and is used to couple the upper inner drill string 14 and the lower inner drill string assembly 24 together as shown in FIG. 3 and FIG. 11-15 so that the upper inner drill string 14 and lower inner drill string assembly 24 rotate together. The lower inner drill string assembly 24 has an interior passageway 25 in fluid communication with the passageway 21 of the inner drill string 14 as shown in FIG. 13.

Figure 4:
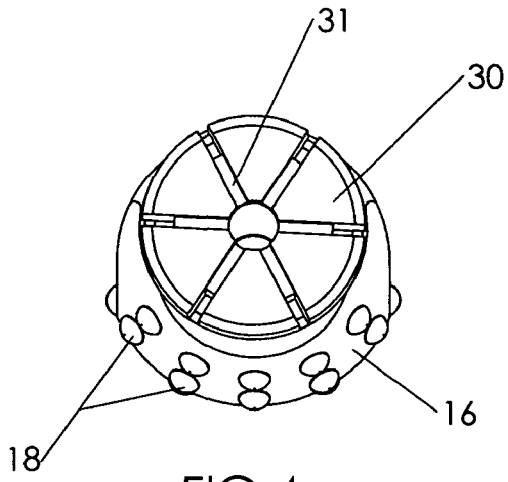
FIG. 4 is a left side elevation view of the drilling system shown in FIG. 1.
Figure 5:
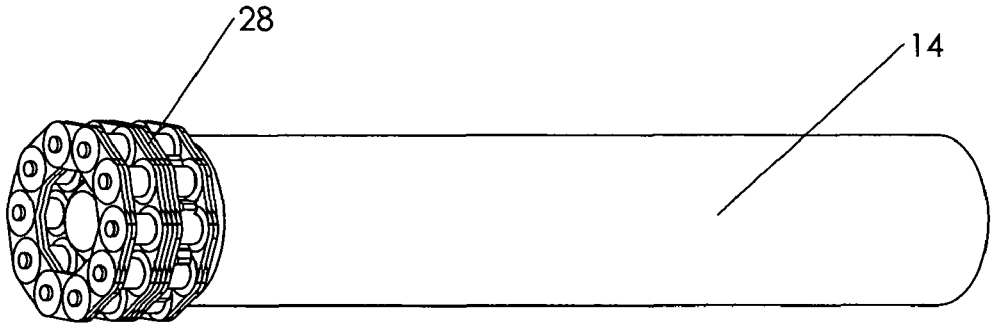
FIG. 5 is a perspective view of an upper inner drill string used with the present invention.
Figure 6:
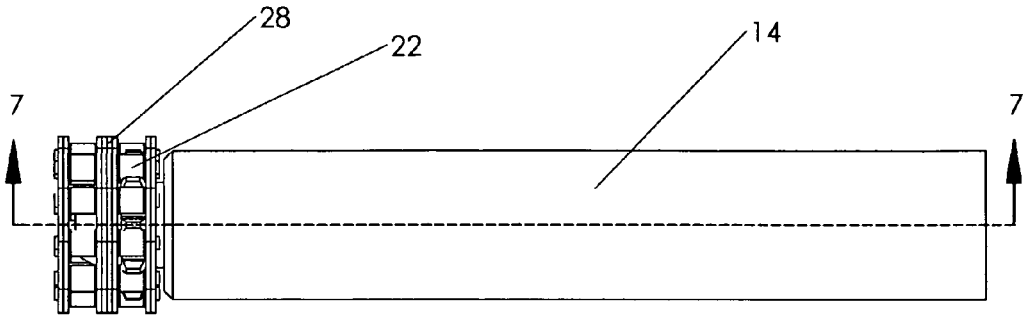
FIG. 6 is an elevational view of the upper inner drill string shown in FIG. 5.
Figure 7:
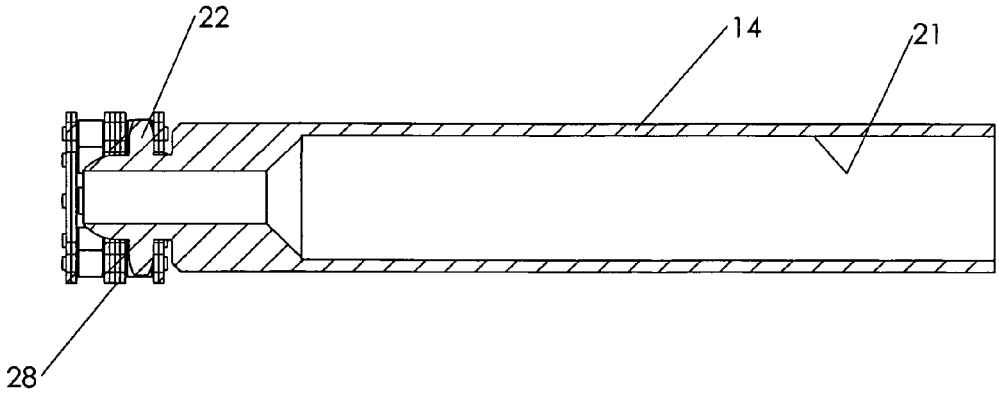
FIG. 7 is a cross-sectional view taken along the line 7-7 in FIG. 6.
Figure 8:
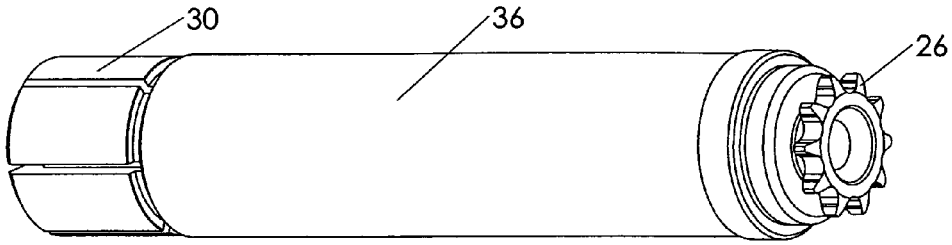
FIG. 8 is a perspective view of a lower inner drill string assembly used with the present invention.
Figure 9:
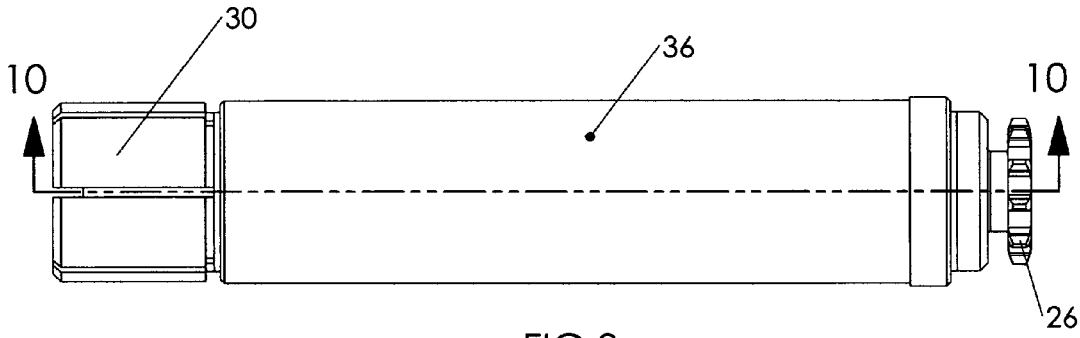
FIG. 9 is an elevational view of the lower inner drill string assembly shown in FIG. 8.
Figure 10:
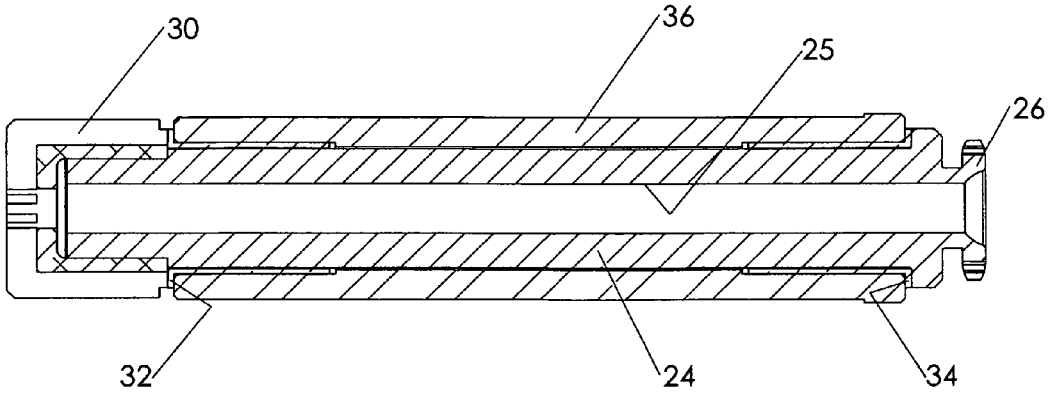
FIG. 10 is a cross-sectional view taken along the line 10-10 in FIG. 9.
Figure 11:
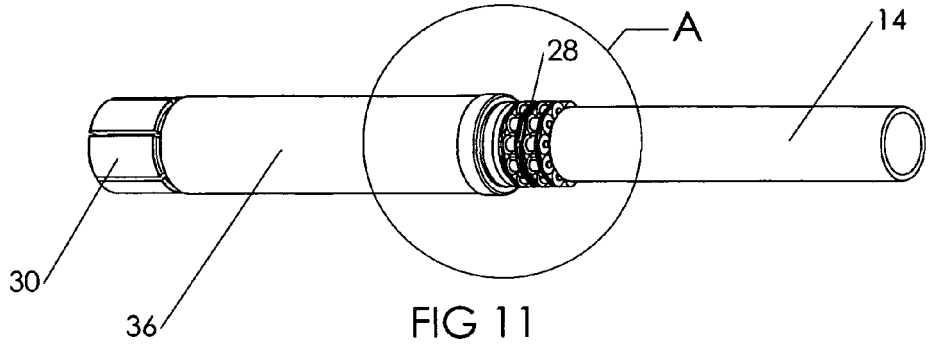
FIG. 11 is a detailed perspective view of the upper inner drill string and lower inner drill string assembly connected together.
Figure 12:
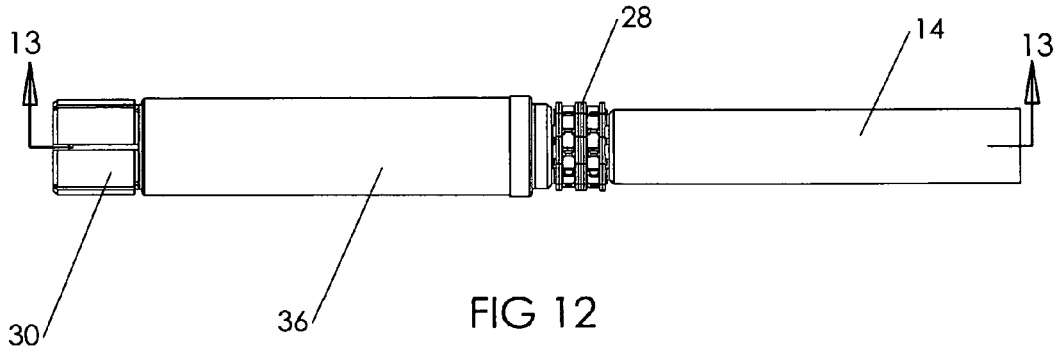
FIG. 12 is an elevational view of the upper inner drill string and lower inner drill string shown in FIG. 11.
Figure 15:
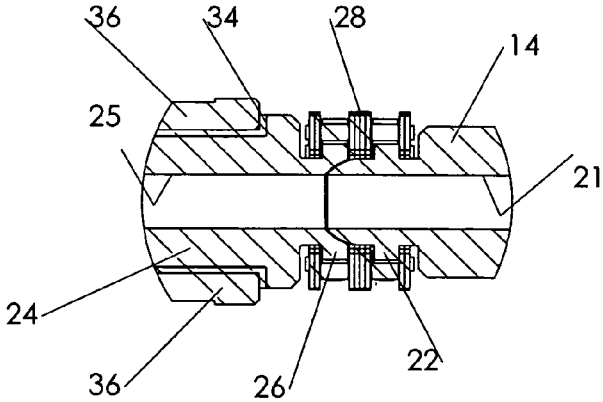
FIG. 15 is a detail view taken at C in FIG. 13.

An inner bit 30 is attached at the bottom end of the lower inner drill string assembly 24 as shown in FIG. 3 with the inner bit 30 extending beyond the outer string driver shoe 16. In a preferred embodiment, bit 30 may be a conventional polycrystalline diamond bit. The inner bit 30 includes openings 31 in fluid communication with the passageway 25 as shown in FIGS. 3 and 4. The outside diameter of the inner bit 30 is larger than the outside diameter of the lower inner string assembly 24 providing a shoulder 32 as shown in FIGS. 3 and 13. Further, the lower inner drill string assembly 24 is provided with a shoulder 34 in spaced apart relation with the shoulder 32 as shown in FIGS. 3 and 15. A sleeve bearing 36 is positioned in surrounding relation to the lower inner drill string assembly 24 and is sized to fit between the shoulders 32 and 34. Thus, the sleeve bearing 36 and inner drill string 24 are restricted from moving outwardly with respect to the outer drill string 12.

The outer string driver shoe 16 is provided with an internal, inclined, off-center bore 38 as shown in FIG. 3. The outer string driver shoe 16 is also provided with a cutaway portion 40 as shown in FIG. 1. The lower inner drill string assembly 24 with sleeve bearing 36 is fitted within the off-center bore 38 and extends out through cutaway portion 40 as shown in FIG. 3. With this construction, as the outer string 12 is rotated, the inner bit 30 orbits around the center line of the outer string 12 during the drilling operation.

Drilling fluid may be injected to the inner bit 30 through the passageways 21 and 25. Drilling fluid is then injected through opening 31 into the bore hole surrounding bits 30 and driver shoe 16. The outer drill string 12 is provided with cutouts 42 as shown in FIGS. 1-3. Drilling fluid is then forced under pressure to move upwards to the earth's surface in the bore hole outside the outer drill string 12, through cutouts 42 and then upwardly in the passageway 20.

In a preferred embodiment, the inner string rotates at a faster rate than the outer string and the outer string can be rotated either in the same direction or in opposite direction as the direction of rotation of the inner string.

As can be seen, the inner bit and the inner drill string can be removed from the outer drill string without removing the outer drill string and outer drill string driver shoe. The orbital cutting by the inner drill string cuts a hole large enough for both drill strings to advance. With the present system, the inner string can be pulled leaving the outer string 12 in place during bit changes and tool insertions. This allows an operator to "case while drilling" so that the hole never falls in when the inner string drill bit 30 is pulled.

While the fundamental novel features of the invention have been shown and described, it should be understood that various substitutions, modifications, and variations may be made by those skilled in the arts, without departing from the spirit or scope of the invention. Accordingly, all such modifications or variations are included in the scope of the invention as defined by the following claims:

We claim:

1. A dual string drilling system connected to a drilling rig for drilling a well bore in an earth formation comprising:

a rotatable, tubular outer drill string having a longitudinal axis;

an upper rotatable tubular inner drill string having a longitudinal axis and an interior passageway with the upper inner drill string concentrically disposed in spaced apart relation within the outer drill string;

an upper end of the outer drill string and an upper end of the upper inner drill string connected to the drilling rig for rotating the drill strings independently of one another;

an elongate tubular driver shoe mounted to a distal end of the outer drill string;

the tubular driver shoe provided with an interior passageway having a longitudinal axis which is inclined with respect to the longitudinal axis of the outer drill string;

the interior passageway of the driver shoe positioned for fluid communication with the interior passageway of the tubular outer drill string;

the tubular driver shoe further provided with a cutaway portion extending through a wall of the tubular outer drill string;

a tubular sleeve bearing disposed within the interior passageway of the tubular driver shoe and extending outwardly through the cutaway portion;

a lower rotatable tubular inner drill string having a longitudinal axis and concentrically disposed within the tubular sleeve bearing;

the lower tubular inner drill string having an interior passageway in fluid communication with an interior passageway of the upper tubular inner drill string;

a drill bit mounted to a distal end of the lower inner drill string and is sized to extend beyond the driver shoe mounted to the outer drill string; and means for coupling the lower inner drill string to the upper inner drill string for causing the lower inner drill string to rotate with the upper inner drill string.

2. A dual string system according to claim 1 wherein the upper and lower inner drill strings are rotated at a higher RPM than the outer drill string.

3. A dual string system according to claim 1 wherein the driver shoe of the outer drill string further includes a shoulder means for limiting outward longitudinal movement of the tubular sleeve bearing and lower inner drill string.

4. A dual string system according to claim 1 further including a passageway for directing drilling fluid from the earth's surface to the distal end of the dual string system and a passageway for returning the drilling fluid to the surface.

5. A dual string system according to claim 1 wherein the driver shoe of the outer drill string further includes bearing buttons provided on the outer periphery of the driver shoe for bearing against an exposed surface of a bore hole when drilling the bore hole.

6. A dual string system according to claim 1 wherein the inner string and associated drill bit are adapted to be pulled from the bore hole while leaving the outer drill string in place.

* * * * *